United States Patent [19]

Pollard et al.

[11] 3,993,100

[45] Nov. 23, 1976

[54] HYDRAULIC CONTROL SYSTEM FOR CONTROLLING A PLURALITY OF UNDERWATER DEVICES

[75] Inventors: Terry W. Pollard; David P. Herd; Jack Whiteman, all of Houston, Tex.

[73] Assignee: Stewart & Stevenson Oiltools, Inc., Houston, Tex.

[22] Filed: Apr. 28, 1975

[21] Appl. No.: 572,039

[30] Foreign Application Priority Data

Apr. 29, 1974 United Kingdom ..... 18753/74

[52] U.S. Cl. ..... 137/628; 137/637; 166/.5

[51] Int. Cl.[2] ..... E21B 43/01

[58] Field of Search ..... 137/628, 629, 637; 166/.5

[56] References Cited

UNITED STATES PATENTS

| | | | |
|---|---|---|---|
| 1,905,065 | 4/1933 | Scholl | 137/637 |
| 3,014,490 | 12/1961 | Morris | 137/628 X |

*Primary Examiner*—Martin P. Schwadron
*Assistant Examiner*—Richard Gerard
*Attorney, Agent, or Firm*—Fulbright & Jaworski

[57] ABSTRACT

A hydraulic control system for controlling a plurality of remotely positioned hydraulically actuated underwater devices by a single hydraulic control line extending underwater. A reference hydraulic manifold is connected to the single control line and a signal hydraulic manifold is connected to the single control line. A pilot actuated hydraulic control valve is connected to each of the underwater devices controlling the flow of actuating fluid thereto. The pilot of each valve is connected to both the reference manifold and the signal manifold, but the pilot of each of the valves is actuated by different pressure levels in the signal manifold whereby the underwater devices may be controlled in a predetermined sequence by applying predetermined pressure levels to the single hydraulic control line. A pressure regulator is positioned in the control line upstream of the reference manifold to maintain the reference manifold at a predetermined pressure level. Time delay and fail safe circuits are provided in the reference manifold and signal manifold. In one embodiment the hydraulic control valves are connected to provide one mode of sequencing the underwater devices. In another embodiment the hydraulic control valves are connected to provide a different mode of sequencing.

12 Claims, 9 Drawing Figures

OPERATING SEQUENCE
| STEP | PRESSURE PSI | VALVE POSITION | | | |
|---|---|---|---|---|---|
| | | SSSV | MASTER | W-1 | W-2 |
| 1 | 0 | CLOSE | CLOSE | CLOSE | CLOSE |
| 2 | 1500 | OPEN | CLOSE | CLOSE | CLOSE |
| 3 | 2000 | OPEN | OPEN | CLOSE | CLOSE |
| 4 | 2500 | OPEN | OPEN | OPEN | OPEN |
| 5 | 3000 | OPEN | OPEN | CLOSE | OPEN |
Fig. 2A
OPERATING SEQUENCE
| STEP | PRESSURE PSI | VALVE POSITION | | | |
|---|---|---|---|---|---|
| | | SSSV | MASTER | W-1 | W-2 |
| 1 | 0 | CLOSE | CLOSE | CLOSE | CLOSE |
| 2 | 1500 | OPEN | CLOSE | CLOSE | CLOSE |
| 3 | 2000 | OPEN | OPEN | CLOSE | CLOSE |
| 4 | 2500 | OPEN | OPEN | OPEN | CLOSE |
| 5 | 3000 | OPEN | OPEN | OPEN | OPEN |
Fig. 1A
Fig. 5
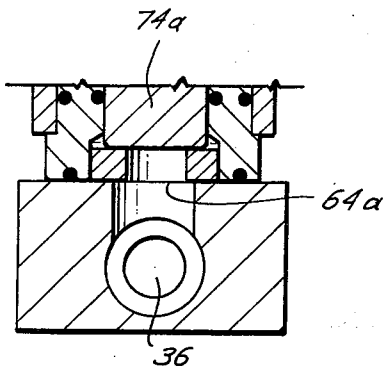
Fig. 6
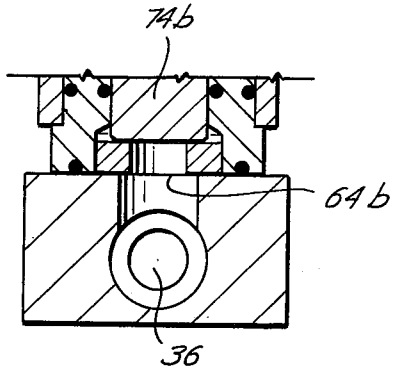
Fig. 7
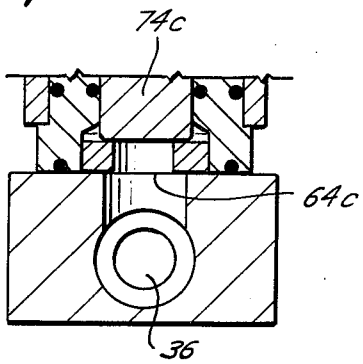

HYDRAULIC CONTROL SYSTEM FOR CONTROLLING A PLURALITY OF UNDERWATER DEVICES

BACKGROUND OF THE INVENTION

Underwater hydraulic control valves, such as used in controlling production or drilling equipment in underwater wells have been controlled in the past by a plurality of electrical or hydraulic control lines. However, as the number of underwater devices to be controlled has increased, the physical size, number and expense of the pilot or control lines required has increased as well as increasing the likelihood of damage to the underwater extending lines, such as shown in U.S. Pat. No. 3,460,614.

The present invention is directed to various improvements in a hydraulic control system for controlling a plurality of hydraulically actuated underwater devices through a single hydraulic line in a desired sequence by applying predetermined pressure levels through the single hydraulic control line.

SUMMARY

The present invention is generally directed to a single hydraulic control line extending underwater for controlling a plurality of hydraulically actuated underwater devices. A pilot actuated hydraulic control valve is connected to each of the underwater devices for controlling the flow of hydraulically actuating fluid to the underwater devices. A reference hydraulic manifold is connected to the single control line for maintaining a reference pressure, and a signal hydraulic manifold is connected to the single control line for providing various control pressure levels therein. The pilot of each of the hydraulic control valves is connected to the reference manifold and to the signal manifold and the pilot of each of the valves is actuated by different pressure levels in the signal manifold whereby the underwater devices may be controlled in a predetermined sequence by applying predetermined pressure levels to the single hydraulic control line.

Yet a still further object of the present invention is the provision of a pressure regulator connected to the reference manifold for maintaining the manifold at a predetermined pressure.

Still a further object of the present invention is the provision of a hydraulic control valve for each of the underwater devices having an inlet and an outlet for controlling the flow of actuating fluid to the underwater devices in which each of the control valves moves to an open and closed position by first and second pilot pistons in which the ratio of the cross-sectional area of the first piston relative to the cross-sectional area of the second piston of at least one of the valves is different from the ratio of other of the control valves.

Still a further object of the present invention is the provision of an orifice valve and check valve in parallel and positioned in the reference manifold in which the check valve is directed to pass fluid towards the hydraulic control valves for providing a fail safe operation.

Still a further object of the present invention is the provision of an orifice valve and a check valve in parallel and positioned in the signal manifold in which the check valve is directed to pass fluid from the hydraulic control valves thereby providing a time delay for actuation of the control valves as well as a fail safe system.

Yet a still further object of the present invention is the provision of connecting the circuits of the hydraulic control valves to provide various desired sequencing operations.

Other and further objects, features and advantages will be apparent from the following description of presently preferred embodiments, given for the purpose of disclosure and taken in conjunction with the accompanying drawings.

BRIEF DESCRIPTION OF THE DRAWINGS

FIG. 1A is a typical operation sequence schedule of the operation of the control system shown in FIG. 1, FIG. 2A is a typical operation sequence schedule of the operation of the control system shown in FIG. 2, FIG. 5 is a cross-sectional view taken along the line 5—5 of FIG. 3, FIG. 6 is a cross-sectional view taken along the line 6—6 of FIG. 3, and FIG. 7 is a cross-sectional view taken along the line 7—7 of FIG. 3.

DESCRIPTION OF THE PREFERRED EMBODIMENT

While the present invention is useful for controlling various types of hydraulically actuated underwater devices, for purposes of illustration only, the present invention will be described in connection with controlling subsea hydraulically actuated devices on a production well.

Figure 1:
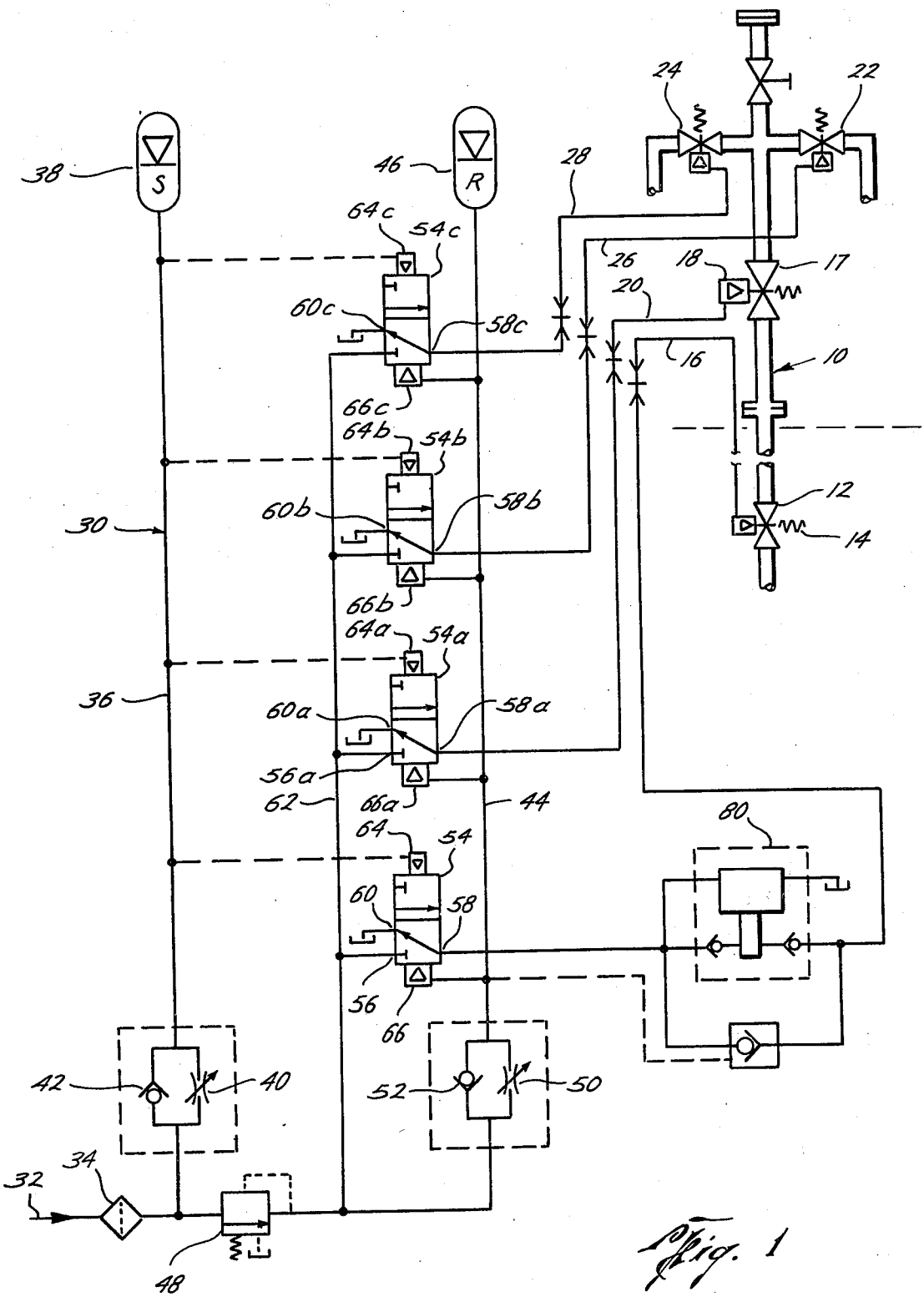
FIG. 1 is a schematic diagram of one embodiment of the present invention.

Referring now to FIG. 1, a subsea oil production well 10 is shown to which various conventional equipment, which is required to be actuated hydraulically and remotely from an above water location, is connected. For example, a subsurface safety valve 12 is connected to the well 10 and is urged to the closed position by a spring 14, but is hydraulically actuated to an open position through a hydraulic line 16. The subsurface safety valve may be of any conventional type such as the Camco B Series. In addition, the well may include a master valve 17 which is normally closed, but is actuated to the open position by a hydraulic actuator 18 through a line 20. The well may also include first and second wing valves 22 and 24 which are hydraulically actuated to an open position through lines 26 and 28, respectively.

The present hydraulic control system, generally indicated by the reference numeral 30, is provided for controlling the hydraulically actuated underwater devices 12, 17, 22 and 24 from a single hydraulic control line 32 which performs the control function of opening and closing the devices 12, 17, 22 and 24, and preferably also provides the power actuating fluid for actuating the underwater devices. The control system 30 transmits its intelligence signals by specific and discrete pressure levels control valves to operate the devices 12, 17, 22 and 24 in a predetermined sequence of operation. Preferably, in the illustration of the production well 10 shown in FIG. 1, it is desired to sequentially open the subsurface safety valve 12 first, then in sequence, the master valve 17, and then first and second wing valves 22 and 24.

A single hydraulic control line 32 is provided leading from a control point to underwater adjacent the production well 10. A filter 34 is provided for filtering the hydraulic fluid. A signal manifold 36 is connected to the single control line 32 and may be connected to an accumulator 38. Preferably, a variable orifice valve 40 and check valve 42 are connected in parallel and positioned in the signal manifold 36 with the check valve directed to freely flow liquid out of the accumulator 38 and manifold 36 as will be more fully discussed hereinafter.

A reference hydraulic manifold 44, preferably including an accumulator 46, is connected to the single control line 32 through a forward pressure regulator 48 which maintains the pressure in the reference manifold 44 at a predetermined pressure. A variable orifice valve 50 and check valve 52 are provided in parallel and positioned in the manifold 44 in which the check valve 52 is directed to freely flow fluid into the accumulator 46 as will be more fully discussed hereinafter.

A plurality of pilot actuated hydraulic control valves 54, 54*a*, 54*b*, and 54*c* are provided, one of which is connected to each of the control devices. Thus, valve 54 is connected to line 16 for actuating subsurface safety valve 12, control valve 54*a* is connected to line 20 for controlling master valve 17, control valve 54*b* is connected to line 26 for controlling wing valve 22, and control valve 54*c* is connected to line 28 for controlling wing valve 24. Each of the control valves 54, 54*a*, 54*b*, and 54*c* includes an inlet and outlet for controlling the flow of hydraulic actuating fluid to its connected underwater device. Thus, valve 54 includes an inlet 56 and an outlet 58, valve 54*a* includes an inlet 56*a* and an outlet 58*a*, valve 54*b* includes an inlet 56*b* and an outlet 58*b*, and valve 54*c* includes an inlet 56*c* and an outlet 58*c*. The control valves may also include a dump outlet. Thus, valve 54 includes a dump outlet 60, control valve 54*a* includes a dump outlet 60*a*, control valve 54*b* includes a dump outlet 60*b*, and control valve 54*c* includes a dump outlet 60*c*. The outlets 58, 58*a*, 58*b* and 58*c* are connected to the actuating lines 16, 20, 26 and 28, respectively. The inlets 56, 56*a*, 56*b* and 56*c* are preferably connected to a common hydraulic power line 62. While the line 62 may be a separate hydraulic power line for actuating the underwater devices 12, 16, 22 and 24, it is preferable that the line 62 be connected to the single control line 32 downstream of the pressure regulator 48 thereby providing a hydraulic control system 30 in which the single line 32 provides not only the control, but the power fluid for operating the underwater devices 12, 17, 22 and 24.

The hydraulic control valves include pilot ports for actuation of the control valves. Thus, control valve 54 includes a first pilot port 64 which is connected to the signal manifold 36 and a second pilot port 66 which is connected to the reference manifold 44. Similarly, valves 54*a*, 54*b* and 54*c* include pilot ports 64*a*, 64*b* and 64*c*, respectively, which are connected to the signal manifold 36, and also include pilot ports 66*a*, 66*b* and 66*c*, respectively, which are connected to the reference manifold 44.

Figure 3:
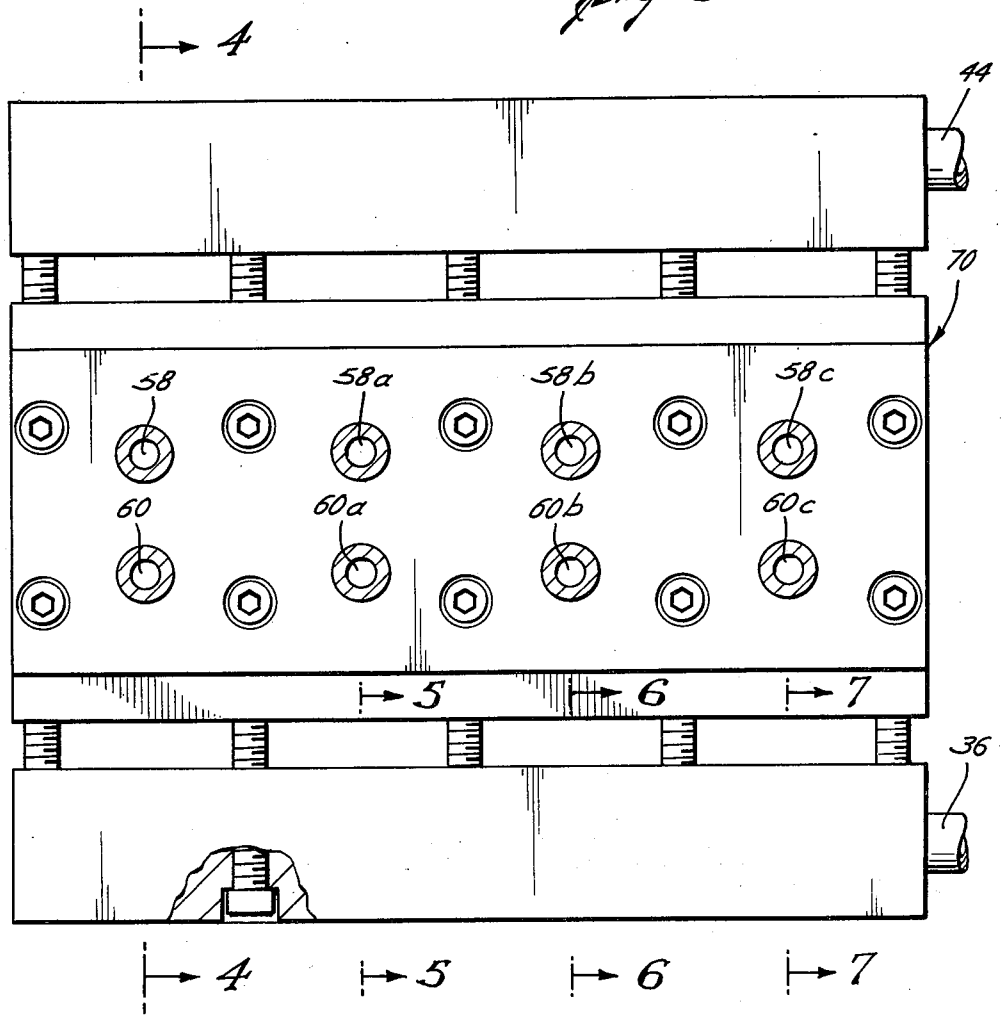
FIG. 3 is an elevational view of a satisfactory valve assembly containing the hydraulic control valves of the present invention.
Figure 4:
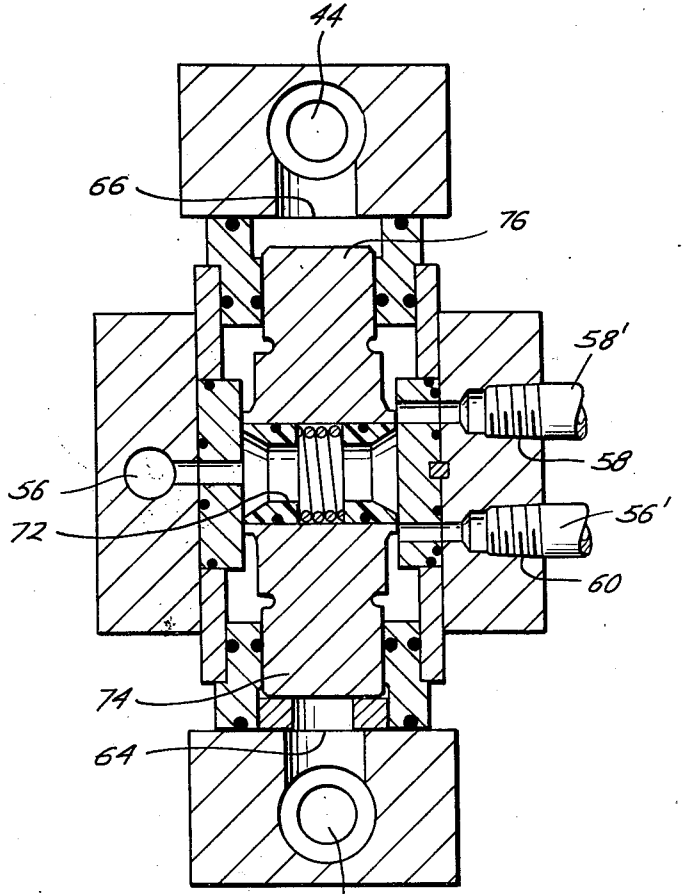
FIG. 4 is a cross-sectional view taken along the line 4—4 of FIG. 3.

Referrring now to FIG. 3, a valve block 70 is best seen which integrally contains all of the control valves 54, 54*a*, 54*b* and 54*c*. Referring now to FIG. 4, cross-sectional view of valve 54 is best seen, shown in the dumping position, in which a valve element 72 is movable to provide communication between the inlet port 56 and the outlet port 58 in one position or, as shown blocks the inlet port 56 and provides communication between the outlet port 58 and the dump port 60 around the valve element 72. The control valve 54 includes a first piston 74 exposed to the pilot signal port 64 and a second piston 76 exposed to the pilot reference port 66. The pistons 74 and 76 are on opposite sides of seal element 72. As shown, the cross-sectional area of the pistons 74 and 76 are equal; therefore, the position of the valve element 72 will depend upon the relationship between the pressure in the reference manifold 44 and the pressure in the signal manifold 36. That is, when the pressure in the signal manifold 36 increases beyond the pressure in the reference manifold 44, the piston 74 will move the seal element 72 to provide communication between the inlet 56 and the outlet 58 to supply actuation fluid to the underwater device 12.

The valves 54*a*, 54*b* and 54*c* similarly include second pistons 76*a*, 76*b* and 76*c*. Similarly, the valves 54*a*, 54*b* and 54*c*, include first pistons 74*a*, 74*b* and 74*c*. However, it is desired that the valves 54, 54*a*, 54*b* and 54*c* be actuated by different pressure levels in the signal manifold 36. One way of obtaining this function is to provide that the ratios of the cross-sectional areas of the first pistons 74, 74*a*, 74*b* and 74*c* relative to the cross-sectional area of the second pistons 76, 76*a*, 76*b*, and 76*c*, respectively, of the valves are different from each other. Thus, referring to FIGS. 4, 5, 6 and 7, it is noted that the first pistons 74, 74*a*, 74*b* and 74*c* decrease in cross-sectional area in sequence. Therefore, while the second pistons 76*a*, 76*b* and 76*c* in each of the valves may be of the same cross-sectional area, by serially decreasing the areas of the first pistons 74, 74*a*, 74*b* and 74*c*, the valves will be actuated in sequence as the pressure in the signal manifold 36 progressively increases to predetermined levels depending upon the pressure in the signal manifold 36, the pressure in the reference manifold 44, and the relative ratios of the cross-sectional areas of the first pistons relative to the second pistons.

Returning now to FIGS. 1 and 4, assume that all of the subsurface devices 12, 17, 22 and 24 are in the closed position, and the valves 54, 54*a*, 54*b* and 54*c* are in the dump position as shown, input supply pressure is applied to the single line 32. Assume that the pressure regulator 48 is provided with a set point of 1500 pounds, that is, it will limit and hold the downstream pressure from the regulator 48 to 1500 pounds. Since the signal manifold 36 is controlled by the orifice 40 in parallel with the check valve 42, the signal manifold control is set so that the signal manifold 36 has a signal input delay, but is quick dumping. The signal input delay is determined by the diameter of the orifice 40 and capacity of the accumulator 38. The purpose of this arrangement is so that small pressure fluctuations or transients will not have an effect on the operation of the hydraulic valves, and also that free flow out of the signal manifold 36 will insure maximum fail safe response.

While the pressure in the reference manifold 44 is limited by the pressure regulator set point, any input supply pressure from zero to the regulator set point, here assumed to be 1500 pounds, is instantly transmitted into the reference manifold 44 through check valve 52. This quick input to the reference manifold 44 assures that the reference manifold 44 always arrives at its prescribed operational condition before the time delayed signal manifold 36 arrives at its prescribed operation. The variable orifice 50 in parallel with the check valve 52 in the reference manifold 44 provides a controlled delay in the out or bleed direction which assures that the reference manifold 44 will maintain its prescribed operational condition after the signal manifold 36 is bled down and loses its set condition and this arrangement further assures maximum fail safe condition.

As has been indicated, the hydraulic control valves 54, 54*a*, 54*b* and 54*c* have an actuation depending upon the pressures in the reference manifold 44, the signal manifold 36, and the ratios of their first and second pistons relative to each other. In the following example, it is assumed that the ratios of the first piston to the second piston of each of the valves 54, 54*a*, 54*b* and 54*c* is such that valve 54 is moved from a closed to an open position on a signal pressure of 1500 pounds, valve 54*a* moves to an open position at 2000 pounds, valve 54*b* moves to an open position at 2500 pounds and valve 54*c* moves to an open position at 3000 pounds.

At input pressure to the line 32 less than 1500 pounds pressure hydraulic fluid flows freely into the reference manifold 44 and accumulator 46. Fluid flows from the reference manifold 44 through the pilot ports 66, 66*a*, 66*b*, and 66*c* acting against the second pistons 76, 76*a*, 76*b* and 76*c* to move all of the control valves to the dump position as shown, and close off the inlets. Referring to the operating schedule of FIG. 1A, when slightly more than 1500 pounds of pressure is applied to the line 32 and after a time delay through the orifice 40, fluid flows into the manifold 36 and accumulator 38, and this pressure will flow to the pilot ports 64, 64*a*, 64*b* and 64*c* of the control valve. In valve 54, since the first and second pistons are equal, the valve 54 will move to the open position since the pressure in the signal manifold is slightly above 1500 pounds and the pressure in the reference manifold is only 1500 pounds, allowing the flow of actuating fluid from line 62 through the valve 54 and to hydraulic line 16 to actuate the subsurface safety valve 12. If desired, an intensifier 80 may be provided in the line 16 to increase the fluid pressure in the line 16 to that required to operate the normally closed fail safe subsurface safety valve 12 to the open position. However, valves 54*a*, 54*b* and 54*c* will not be actuated at this time because of the smaller cross-sectional areas of their first pistons relative to their second pistons.

When the pressure in the single control line 32 is increased until 2000 psi, valve 54*a* is actuated since the increased pressure of 2000 pounds acting on the similar first piston 74*a* overcomes the 1500 pound pressure acting on the larger second piston 76*a* (not shown), to open valve 54*a* and allow actuating fluid from line 62 to flow to line 20, at the regulator pressure of 1500 psi, to flow to a normally closed fail safe master gate valve 17 thereby opening the valve 17 into its open position. At this time, the pressure in the signal manifold 36 is not sufficient to actuate control valves 54*b* and 54*c*, but is still greater than the actuation of 1500 pounds to actuate valve 54 and therefore valve 54 remains opened. As the pressure in line 32 is increased, until the 2500 psi pressure level is obtained, valve 54*b* is actuated to the open position flowing hydraulic actuating fluid from line 62 to line 26 to actuate wing valve 22 and move it into the open position. All conditions previously described will hold and persist until 3000 psi pressure level is obtained in the line 32 at which time valve 54*c* is actuated to the open position and hydraulic fluid from power line 62 will flow to line 28 to open wing valve 24.

The closing order in FIGS. 1 and 1A is exactly the reverse of the opening order and any previous pressure level may be returned to which will close the control valves 54, 54*a*, 54*b* and 54*c* having a higher pressure, yet holding valves open which have a lower pressure threshold. The closing order proceeds as quickly as the pressure in line 32 is reduced since the pressure in the signal manifold 36 may be quickly dumped through the check valve 42 while the pressure in the reference manifold 44 is maintained through the time delay orifice 50. When the signal pressure becomes less than 1500 psi, all of the control valves 54, 54*a*, 54*b* and 54*c* are moved to the dumped position relieving the pressure in the lines 16, 26 and 28 thereby closing the valves 12, 17 and 24. Furthermore, any underwater fluid actuated device 12, 17 and 24 may be opened or closed in its specific order without regard to whether a complete closed cycle is performed.

Figure 2:
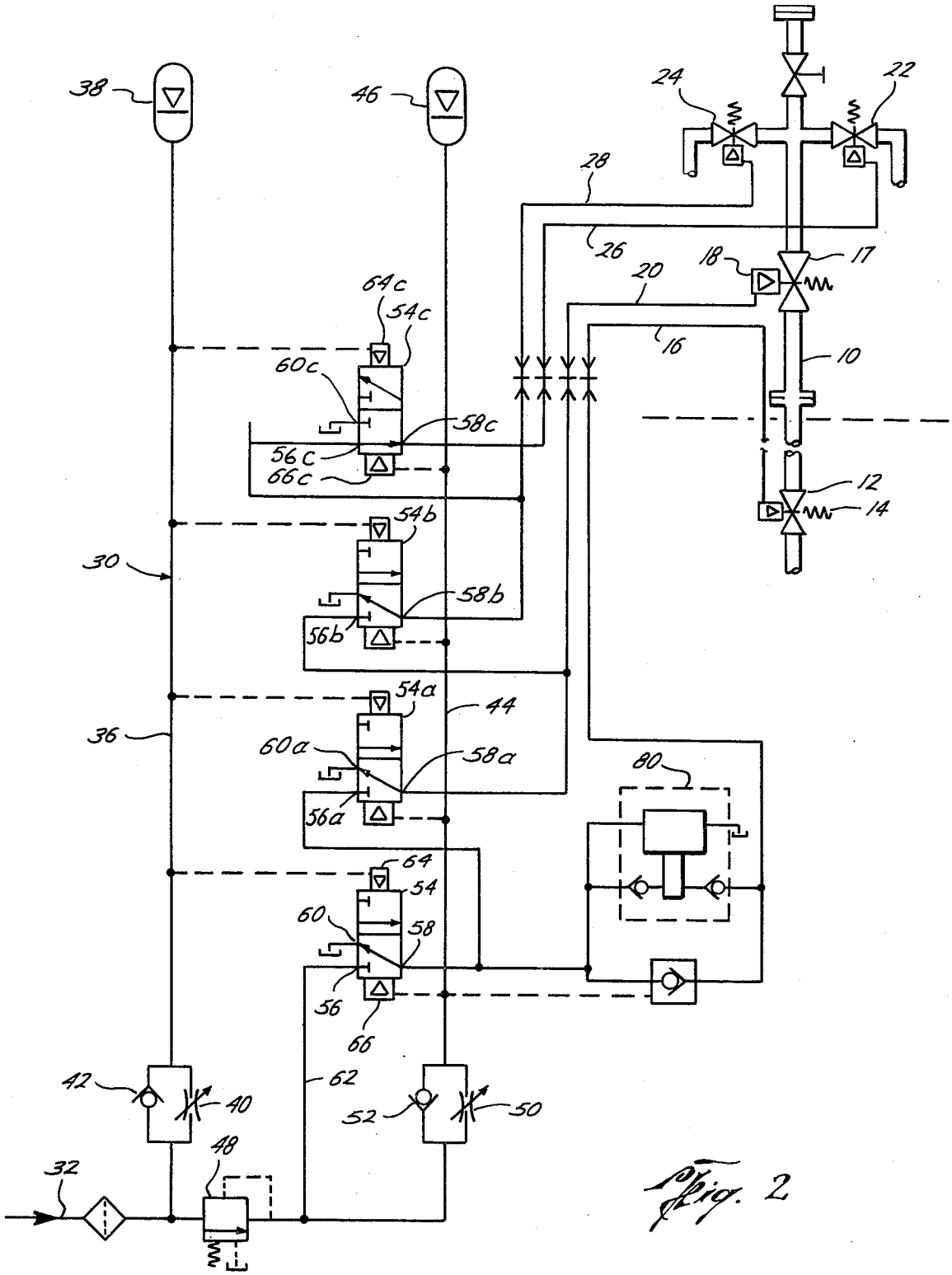
FIG. 2 is a schematic diagram of a further embodiment of the present invention.

While the control system 30 shown in FIG. 1 is designed so that each of the control valves 54, 54*a*, 54*b* and 54*c* operate at a predetermined sequence and pressure level, they are positioned in parallel and their operation is independent of each other. However, the circuitry of the control system 30 may be varied to provide a varied operating sequence. Referring now to FIG. 2, the hydraulic control valves 54, 54*a*, 54*b* and 54*c* are connected in series. That is, only the inlet 56 of valve 54 is connected to the power line 62. The inlet 56*a* of valve 54*a* is connected to the outlet 58 of valve 54. Therefore, valve 54*a* is unable to transmit actuating fluid to line 20, even though valve 54*a* is actuated to the open position until valve 54 is opened. Similarly, the inlet 56*b* of valve 54*b* is connected to the outlet 58*a* of valve 54*a*, and the inlet 56*b* of valve 54*c* is connected to the outlet 58*b* of valve 54*b*. This series connection of the control valves 54, 54*a*, 54*b* and 54*c* provides further assurance that the underwater devices 12, 17, 22 and 24 are opened in sequence.

A varied operating sequence is achieved in FIG. 2 by rearranging the power ports of valve 54*c* so that valve 54*c* in FIG. 2 is in the normally opened position instead of the dump position. Therefore, as indicated in the operating schedule in FIG. 2A, while the operation and sequence of the system of FIG. 2 is the same as that shown in FIGS. 1 and 1A for the first three sequencing steps, the operation becomes different when the pressure in the control line 32 reaches 2500 pounds. That is, at 2500 pounds, valve 54*b* is opened which supplies actuating fluid to line 28 to actuate wing valve 24. However, since control valve 54*c* is normally open, actuating fluid from port 58*b* of valve 54*b* flows through the inlet 56*c* and outlet 58*c* of the control valve 54*c* to simultaneously supply actuating fluid to line 26 and actuate wing valve 22. Then, when the pressure in the control line 32 reaches 3000 pounds, valve 54*c* is actuated to the dump position closing wing valve 22. Therefore, by selective connection of the circuitry, variations in the operating sequence may be provided.

The present invention, therefore, is well adapted to carry out the objects and attain the ends and advantages mentioned as well as others inherent therein. While presently preferred embodiments of the invention are given for the purpose of disclosure, numerous changes in the details of construction and arrangement of parts will readily suggest themselves to those skilled in the art and which are encompassed within the spirit of the invention and the scope of the appended claims.

What is claimed is:

1. A hydraulic control system for controlling a plurality of hydraulically actuated underwater devices comprising, a single hydraulic control line extending underwater, a pressure regulator connected to said single hydraulic line, a reference hydraulic manifold connected to said single control line downstream of said pressure regulator, a signal hydraulic manifold connected to said single control line upstream of the pressure regulator, a plurality of pilot actuated hydraulic control valves, each having an inlet and outlet and controlling the flow of hydraulic actuating fluid and individually connected to each of said underwater devices, said pilot of each valve connected to said reference manifold and to said signal manifold and responsive to the pressures in said manifolds, the pilot of each of said valves being actuated by different pressure levels in said signal manifold whereby the underwater devices may be controlled in a desired sequence by applying predetermined pressure levels to said single hydraulic control line.

2. A hydraulic control system for controlling a plurality of hydraulically actuated underwater devices comprising, a single hydraulic control line extending underwater, a plurality of hydraulic control valves, each having an inlet and an outlet and controlling the flow of hydraulic actuating fluid and individually connected to each of said underwater devices, each of said control valves controlled for movement to open and closed positions by first and second pistons, the ratio of the cross-sectional area of the first piston relative to the cross-sectional area of the second piston of at least one of the valves being different from the ratio of the cross-sectional area of the first piston relative to the cross-sectional area of the second piston of other of said control valves, a reference hydraulic manifold connected to said single control line and to said second piston of each valve for holding a reference pressure on said second pistons, a signal hydraulic manifold connected to said single control line and to the first piston of each valve whereby said control valves and said connected underwater devices may be controlled in a desired sequence by applying predetermined pressure levels to said single hydraulic control line.

3. The apparatus of claim 2 wherein the inlet of each of the hydraulic control valves is connected to said single control line.

4. The apparatus of claim 2 wherein the inlet of one of the hydraulic control valves is connected to said single control line and the outlet of said one control valve is connected to the inlet of another hydraulic control valve.

5. The apparatus of claim 4 wherein said one control valve is normally in the closed position and said other hydraulic control valve is normally in the open position.

6. The apparatus of claim 2 including, a pressure regulator connected to the reference manifold.

7. The apparatus of claim 2 including an orifice valve and check valve in parallel and positioned in the reference manifold in which the check valve is directed to pass fluid toward said second pistons.

8. The apparatus of claim 2 including an orifice valve and a check valve in parallel and positioned in the signal manifold in which the check valve is directed to pass fluid from said first pistons.

9. A hydraulic control system for controlling a plurality of hydraulically actuated underwater devices comprising, a single hydraulic control line extending underwater, a plurality of hydraulic control valves, each having an inlet and an outlet and controlling the flow of hydraulic actuating fluid and individually connected to each of said underwater devices, each of said control valves controlled for movement to open and closed positions by first and second pistons, the ratios of the cross-sectional area of the first piston relative to the cross-sectional area of the second piston of the valves being different from each other, a pressure regulator connected to the single hydraulic control line, a reference hydraulic manifold connected to said single control line downstream of said pressure regulator and connected to said second piston of each valve for holding a reference pressure on said second pistons, a signal hydraulic manifold connected to said single control line upstream of the pressure regulator and connected to the first piston of each valve whereby said control valve and said connected underwater devices may be controlled in a desired sequence by applying predetermined pressure levels to said single hydraulic control line.

10. The apparatus of claim 9 wherein the inlets of each of the hydraulic control valves are connected to the single control line downstream of the pressure regulator.

11. The apparatus of claim 9 wherein the inlet of one of the hydraulic control valves is connected to the single control line downstream of the pressure regulator and the inlets and outlets of the other control valves are connected in series with the one control valve.

12. The apparatus of claim 9 including, an orifice valve and check valve in parallel and positioned in the reference manifold in which the check valve is directed to pass fluid toward said second pistons, and an orifice valve and a check valve in parallel and positioned in the signal manifold in which the check valve is directed to pass fluid from said first pistons.

* * * * *